US008540320B2

(12) United States Patent
Sollami

(10) Patent No.: US 8,540,320 B2
(45) Date of Patent: Sep. 24, 2013

(54) SLOTTED SHANK BIT HOLDER

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 825 days.

(21) Appl. No.: 12/417,457

(22) Filed: Apr. 2, 2009

(65) Prior Publication Data

US 2010/0253130 A1 Oct. 7, 2010

(51) Int. Cl.
*E21C 35/19* (2006.01)

(52) U.S. Cl.
USPC ..... 299/102

(58) Field of Classification Search
USPC ..... 175/327, 339; 299/79.1, 102–107, 299/110, 111
See application file for complete search history.

(56) References Cited

U.S. PATENT DOCUMENTS

| | | | | |
|---|---|---|---|---|
| 3,397,012 | A | 8/1968 | Krekeler | |
| 3,865,437 | A | 2/1975 | Crosby | |
| 4,084,856 | A * | 4/1978 | Emmerich et al. | 299/104 |
| 4,844,550 | A | 7/1989 | Beebe | |
| 5,067,775 | A | 11/1991 | D'Angelo | |
| 5,088,797 | A | 2/1992 | O'Neill | |
| 5,273,343 | A | 12/1993 | Ojanen | |
| 5,302,005 | A | 4/1994 | O'Neill | |
| 5,303,984 | A | 4/1994 | Ojanen | |
| 5,628,549 | A | 5/1997 | Ritchey | |
| 5,725,283 | A | 3/1998 | O'Neill | |
| D420,013 | S | 2/2000 | Warren | |
| 6,176,552 | B1 | 1/2001 | Topka | |
| 6,371,567 | B1 * | 4/2002 | Sollami | 299/104 |
| 6,685,273 | B1 | 2/2004 | Sollami | |
| 7,097,258 | B2 | 8/2006 | Sollami | |
| 7,118,181 | B2 | 10/2006 | Frear | |
| 7,270,379 | B2 * | 9/2007 | Stehney | 299/104 |

* cited by examiner

*Primary Examiner* — John Kreck
(74) *Attorney, Agent, or Firm* — Patnaude & Videbeck

(57) ABSTRACT

A quick change type bit holder for use in a bit assembly for road milling, road planing, trenching and mining equipment wherein a bit shank extends completely through an axially oriented bit holder bore includes a slotted shank having an outwardly tapered bit holder bore wherein insertion of the bit shank in a bit block acts to slightly collapse the shank which collapses the tapered bore to a generally cylindrical configuration that preferably snugly retains the bit shank rotatably therein.

4 Claims, 4 Drawing Sheets

SLOTTED SHANK BIT HOLDER

This invention relates generally to road milling, road planing, trenching and mining equipment and, more particularly, to an improvement in a quick change bit holder for use in an assembly including bits, bit holders and bit blocks.

BACKGROUND OF THE INVENTION

Road milling, road planing, mining and trenching equipment frequently utilize similar cutting bits and bit assemblies for ripping up old road surfaces, digging trenches for infrastructure or construction purposes, and for mining various minerals. Bit assemblies for these differing applications may use similarly shaped but differently sized bits and bit assemblies. The shanks of road milling bits may approximate ¾ inch in diameter. Road planing bits are larger. Mining bit shanks may very from 1 to 1½ inches in diameter, and trenching bits may be even bigger. Additionally, the length of bit shanks may vary in that road milling bits may not extend completely through a central through bore of a bit holder, while bit shanks used for road planing, trenching and/or mining may extend completely through the bit holder and be retained or fastened on the back side of the bit holder bore.

One such apparatus for holding a cutting bit is shown in U.S. Pat. No. 5,302,005, issued to O'Neill on Apr. 12, 1994.

A bit holder design similar to that shown in FIG. 7 of the O'Neill '005 patent is utilized in the mining industry. The bit holder in the O'Neill '005 design is press fit into the bit block and the dimensions of the outside of the bit holder shank as provided on original equipment machinery are a maximum of 0.005 larger than the corresponding dimensions of the bit block bore. The press or interference fit portions of the bit holder are the cylindrical portions of the outside of the bit holder shank. The central tapered portion of the bit holder shank are less than a seating taper, i.e., less than about 3½ degrees per side. In operation, however, it is understood that typically a multiple set of replacement oversized bit holders are carried in the field with the equipment because of the impacting and abuse that the mining operation imparts on the bit holders and bit blocks of the bit assembly.

It has been discovered that after some use, the press fit on original equipment bit holders becomes loose and tends to pop out of the bit blocks. A first replacement bit holder is utilized that is 0.010 oversize to fit where the original equipment 0.003-0.005 oversize bit holder originally fit. Additionally, 0.015 oversize bit holders and 0.020 oversize bit holders are also carried in the field to replace the 0.010 and 0.015 oversize bit holders when they become loose and also tend to pop out of the bit block bore after extended use. This entire cycle of 0.005, 0.010, 0.015 and 0.020 oversize bit holders may be utilized during the lifespan of a drum or chain assembly on which the bit blocks are mounted.

After reviewing the structure of the bit assemblies shown in the '005 patent, especially those with multiple differing sized, cylindrical upper and lower shank portions, it became apparent to me that the tolerances which need to be met to provide satisfactory surface contact between both the upper and lower cylindrical shank surfaces on the bit holder and their counterparts on the bit block bore are very difficult and costly to achieve, to prevent separation of the holder from the bit block bore in the extreme cutting conditions encountered in road planing, trench digging and mining operations. The solid tapered surfaces also complicate the matching of complementary surfaces between the two parts.

More than likely, press fitting the bit holder in the bit block quickly, or in the field, results in a mis-match of at least one pair of the two pairs of complementary cylindrical surfaces.

Any such mis-match would result in voids between at least portions of the adjacent cylindrical surfaces. In use, these voids would aid in movement between the bit holder shank and bit block bore that would increase over time. Eventually, the enlarging movement would deform the adjacent parts until the bit holder would become loose and eject out of the bit block, which is what has happened in the field.

A need has arisen for an improved bit holder, generally of the type used in the O'Neill '005, patent that will remain mounted in its bit block bore during use for an extended period of time.

Another object of the present invention is the provision of an improved bit holder that may be inserted in a bit block bore with a greater interference fit such that it will remain mounted in that bore during abusive use and for an extended period of time, and yet matingly receive the shank of a bit when that the shank extends completely through the central bore of the improved bit holder to prevent deleterious movement between the bit shank and bit holder bore.

SUMMARY OF THE INVENTION

The invention resides in a bit holder that comprises a front body portion. It also includes a rear shank portion that extends axially from the front body portion. It has a central bore that extends axially through both the front body portion and the rear shank portion. An axially oriented slot means extends along at least a portion of the shank in order to provide an open area into which portions of the shank may collapse as the shank is pressed onto a bit block bore. It further includes relief means on the bit block bore internally adjacent the slot means for providing a substantially cylindrical bit holder bore when the shank is pressed onto the bit block bore.

BRIEF DESCRIPTION OF THE DRAWINGS

The features of the present invention which are believed to be novel are set forth with particularity in the appended claims. The invention may best be understood from the following detailed description of a currently illustrated embodiment thereof taken in conjunction with the accompanying drawings wherein like numerals refer to like parts, and in which:

DETAILED DESCRIPTION OF THE ILLUSTRATED EMBODIMENT

Figure 1:
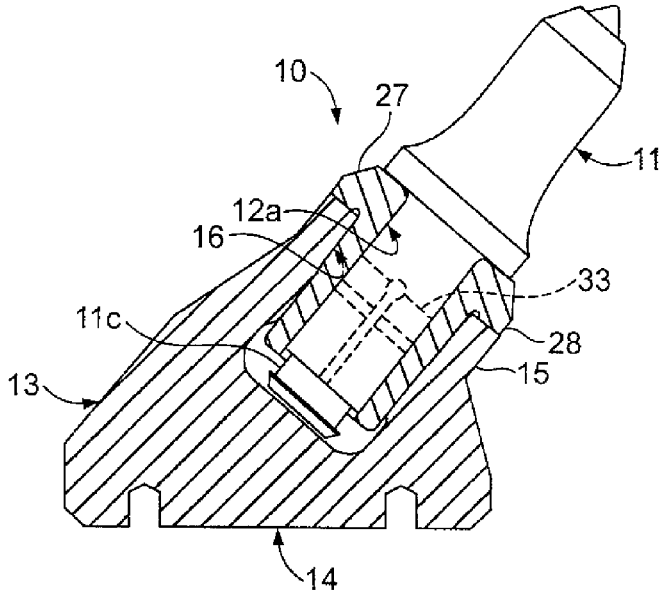
FIG. 1 is a side elevational view of a bit assembly constructed in accordance with the present invention including a mining bit, a bit holder shown in cross-section and a bit block therefor also shown in vertical cross-section.
Figure 2:
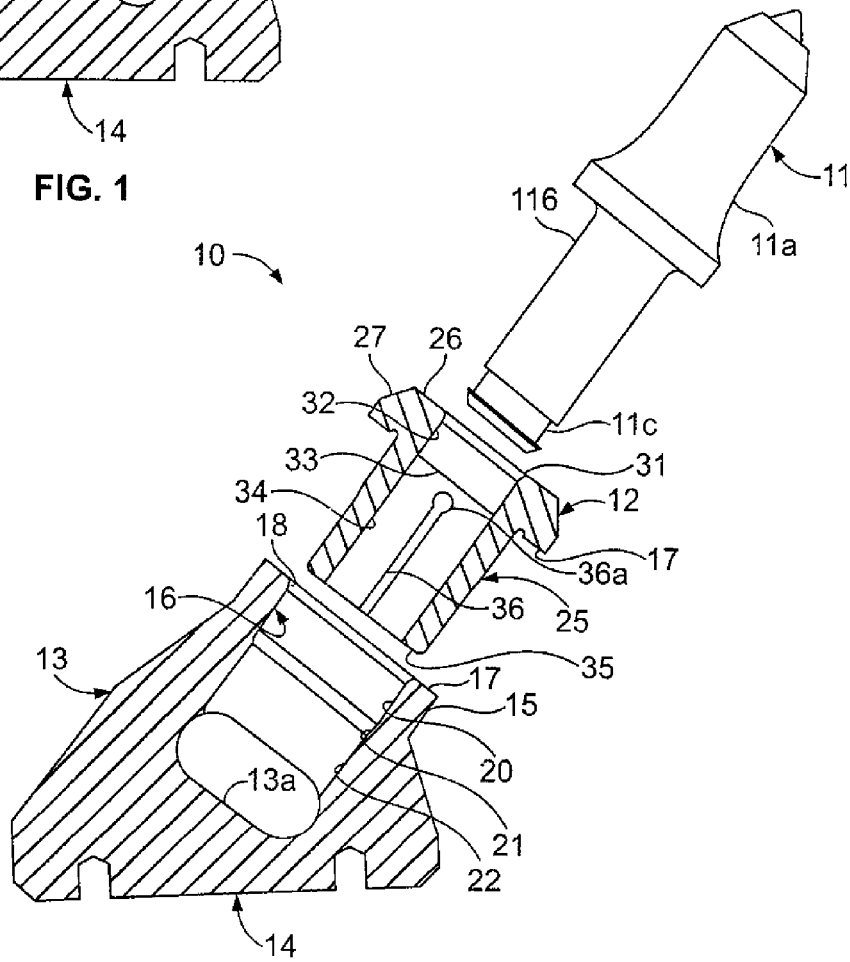
FIG. 2 is a detail exploded view of the bit holder and bit block shown in cross-section in FIG. 1.
Figure 3:
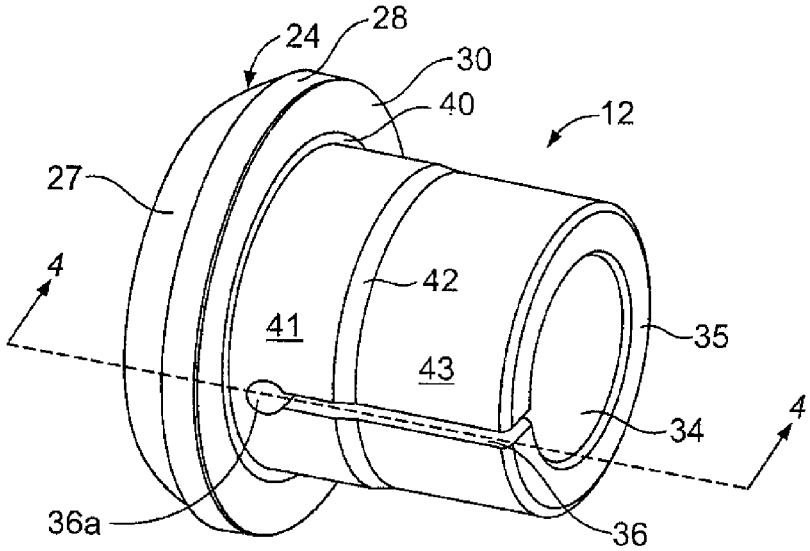
FIG. 3 is an enlarged perspective view of the bit holder of the present invention.

Referring to FIGS. 1, 2 and 3, the typical bit assembly used in mining is generally indicated at 10, and includes, in combination, a bit, generally indicated at 11, which fits into a bit holder, constructed in accordance with the present invention, which in turn fits into a bit block 13. The bit block is mounted on a rotatable drum or continuous chain assembly (not shown). As shown most clearly in FIG. 1, in this bit assembly, which is used mainly in mining operations, the bit 11 includes a forward body portion 11*a* and a generally cylindrical shank 11*b* that extends axially therefrom and is sized lengthwise to extend completely through the bit holder 12 in which it is mounted so that it extends out the rear thereof and into an opening 13*a* in the bit block 13 through which a spring clip or other device (not shown) may be fastened adjacent the distal end of the bit shank. The bit block 13, into which the bit holder 12 is mounted includes a base 14 which may be flat as shown or slightly concave to fit on a cylindrical drum (not shown) and an upper body portion 15 which can be generally annular in shape and includes a stepped bore, generally indicated at 16 and an annular top surface 17.

Referring to FIG. 2, the bit block bore, generally indicated at 16 is a multi-step generally cylindrical bore that extends from the top annular surface 17 to the recess 13*a* toward the base 14 of the bit block 13. Inwardly adjacent the top annular bit holder mounting surface 17 on the bit block is a beveled edge 18 and inwardly thereof is a first or top cylindrical press fit portion 20 of about 1.855 inch diameter which extends 1 5/32 inch axially along the bore. At the bottom end of first press fit portion 20 is a transition taper portion 21 that is about 5/32 inch in axial length and tapers at an included angle greater than 7 degrees so that it is a slip taper and not a locking taper. At the bottom of slip taper 21 is a second or smaller hollow cylindrical press fit portion 22 of about 1.812 inches in diameter that extends axially therefrom to extend into the upper side of the bit block recess 13*a*.

The bit holder 12 as shown in FIGS. 1-3, includes a body or front portion, generally indicated at 24, and a shank portion, generally indicated at 25, extending axially from the base of the body portion. The top or body portion of the bit holder 12 includes, in this illustrated embodiment, a generally flat annular surface 26, a frustoconical side wall 27 extending at an angle axially from the outer edge of the flat annular surface and an outer generally cylindrical wall 28 that extends to a bottom wall which is a generally radially extending annular ring 30. The bit holder bore extends from the inside of the annular top surface 26 with a beveled edge 31. From the bottom of the beveled edge, a cylindrical portion 32 extends axially beyond the axial position of the flat annular surface 30 of the outside of the body portion to a circumferential line shown at 33 in FIG. 2.

Circumferential line 33 that is about 23/32 inch from the top flat surface in this embodiment, divides the cylindrical portion 32 of the bit holder bore from an outwardly tapering portion 34 that extends from about line 33 to the distal end 35 of the bit holder shank. It should be noted that the position of line 33 is somewhat variable along the length of shank 25. It is also variable with respect to its location relative to the inner end 36*a* of slot 36. Additionally, a hollow slot, generally indicated at 36, is in this embodiment, approximately 1/8 inch in width and extends from the annular distal end 35 of the shank upward to about the center of the rounded or circular inner end 36*a* of the slot which centerline runs through the bore dividing line 33. The significance of these features will be discussed in greater detail below.

The material used for the bit holder has to have spring steel characteristics. 4140, 8640, 4340 or similar steels are a preferred material for the heaviest duty cutting applications. It may be possible to use other steels for lighter applications. Also, while forged steel is preferred, holders may be formed from bar stock. The bit holder material has to have a substantial elastic memory in the range of the deformations (radial collapses) shown herein.

Referring to FIGS. 3, 4, 5 and 6, the illustrated embodiment of the bit holder of the present invention 12 is shown in greater detail. FIG. 3 discloses that the outside of the shank, generally indicated at 25 is complementary to the bore 16 of the bit block 13. The front or body portion, generally indicated at 24 has been described in connection with FIGS. 1 and 2 previously. The interior most portion of the back annular face 30 of the body of the bit holder 12 includes an annular rounded fillet 40 that provides a less stress-inducing transition between the front body portion 24 and the back shank 25. The shank 25 includes an upper generally cylindrical portion 41 of 1.870 inches in diameter extending axially from the rounded shoulder 40. In the illustrated embodiment, after 11/16 inch, the generally cylindrical upper portion 41 turns into a tapered portion 42 which has a slip taper, not a locking taper. At the bottom of taper portion 42, which 3/16 inch in axial length tapering at 6 degrees/side, a lower generally cylindrical portion 43 of 1.827 inches in diameter extends to the distal end 35 of the shank. As shown in FIG. 3, the generally circular inward end 36*a* of slot 36 extends generally from about the juncture of the curved shoulder 40 and the upper portion 41 of shank 25 axially toward the distal end of the shank. At the bottom of the circular inner end 36*a*, the slot extends from there axially to the distal end 35 of the shank 25. As indicated in this illustrated embodiment, the width of the slot approximates 1/8 inch and the diameter of the circular inner end approximates 1/4 inch. While prior bit holders that had unslotted shanks have been used in connection with the bit blocks 13 shown in FIGS. 1 and 2, these prior bit holders were made to press or interference fit in the bit blocks and with an outer diameter approximating 1.85 inches, the standard heavy duty press fit indicated an interference of approximately 0.005 inch in both the upper shank portion 41 and the lower shank portion 43 (which is 1.80 inches in diameter before insertion).

As mentioned in the background above, these prior bit holders during use worked themselves out of the bit blocks they were mounted in. Then successive 0.005 and 0.010 oversize (over the original 0.003-0.005 oversize) bit holders were used to serially replace the bit holders after they worked themselves out of their bit blocks. This necessitated having on hand in the field substantial spare parts. The present invention, when used as original equipment, has drastically reduced the need for spare bit holders in the field. It is a one-size-fits-all solution wherein the shank is able to expand radially like a roll pin and retain a bit holder in its bit block even after substantial use and wear. If used as a replacement part, the bit holder of the invention becomes the last spare needed for the useful life of the bit block. If replacement of the sleeve is necessary due to excessive sleeve bore wear, this new style sleeve will fit the same base block.

In this embodiment, the circular end portion 36*a* of slot 36 is approximately 1/4 inch in diameter, although it will be understood that almost any rounded shape that lessens the possibility of stress fractures may be used within the scope of the present invention. The slot width is determined by the need for more or less radial holding force.

Figure 4:
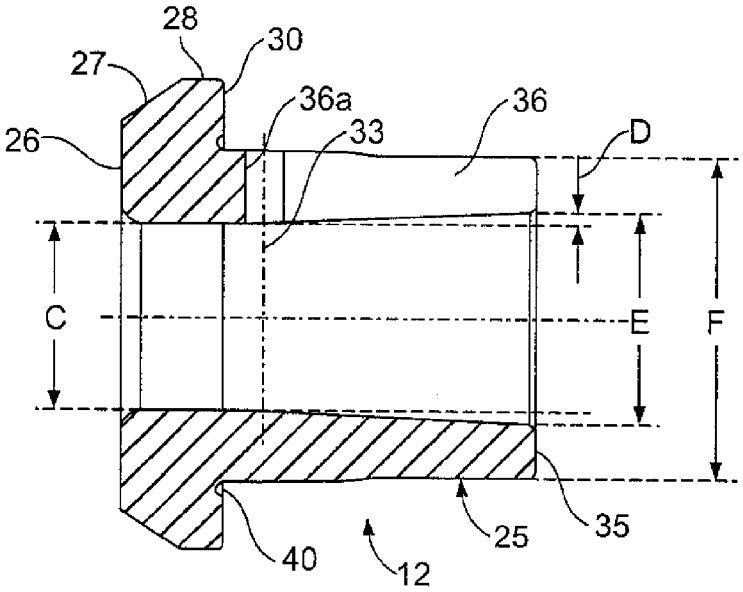
FIG. 4 is a cross-sectional view of an enlarged cross-sectional view of the bit holder shown in FIG. 3 taken substantially along lines 4-4 of FIG. 3.
Figure 6:
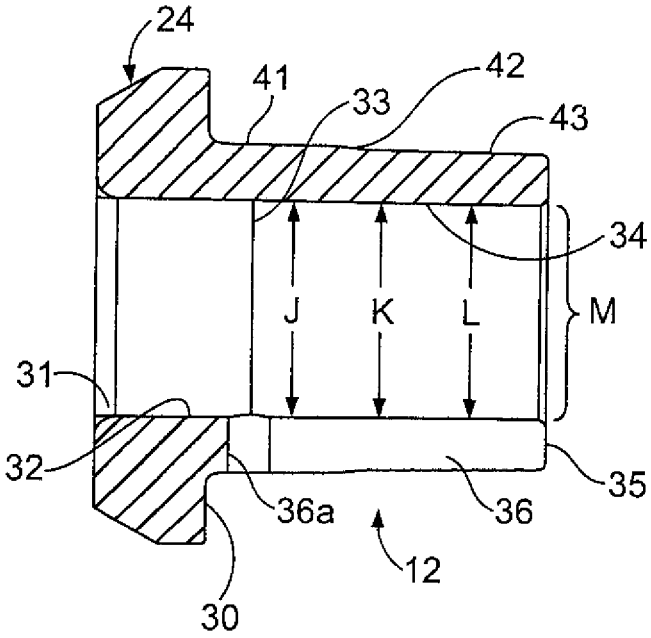
FIG. 6 is a cross-sectional view of a bit holder similar to FIG. 4 as it would appear inserted in the bit block as shown in FIG. 1.

Referring to FIGS. 4 and 6, in one aspect of the present invention, the outwardly tapered bit holder bore in the shank portion of the bit holder is shown in slightly exaggerated form for emphasis. In this embodiment, the diameter C of the bit holder bore is 1.195 inches from the annular top surface 26 to the centerline 33 of the slot inner circular end 36.

Originally, before deciding on the taper shown at D in FIG. 4, an original shank bit holder was slotted and then inserted in its bit block and the collapsed dimensions at the positions J, K, L and M in FIG. 6 were measured as 1.190, 1.185, 1.179 and 1.175 inches, respectively. In order to reach the desired substantially straight bit holder bore of 1.195 ±0.005, the required taper for an uncompressed shank bore was computed to be 0.020, substantially equal to the oversize of the shank outer diameter. It will be understood that a single or multiple step (discontinuous) bore may also be used if the successive steps are small. Although the bit holder shank is not a continuous cylinder, a continuous taper works well for this application.

Dimension D adjacent the rear annular flange surface 35 of shank 25 is 0.007 inch per side or 0.015 inch, on a diameter, which yields an overall diameter E greater than dimension C or 1.210 inches. If the diameter C plus 0.015 adjacent the distal end 35 of the shank is 0.015 greater than dimension C, dimension F, the outer diameter of the lower shank cylindrical portion, would also be 0.015 greater than the bottom or small cylinder bore 22 of the bit block 13. For the illustrated embodiment, it has been determined that about 6,500 pounds of radial force is required to collapse the sleeve outer diameter 0.015 at the distal end portion of the shank. By collapsing the sleeve 0.015 of an inch, the taper D shown in FIG. 4 disappears and any excess diameter in the shank collapses the slot 36 similarly to that shown in FIG. 1.

When inserted in the bit block, as shown in FIG. 1, the bit holder bore 12*a* takes on the dimensions shown in FIG. 6, i.e., the bit holder bore is substantially straight and nearly cylindrical through its length. Thus, the bit holder bore is capable of accepting the bit shank 11*b* in a satisfactory configuration. The bit 11 is still capable of rotating in the bit holder bore 12*a*. Also, the fit between the shank 11*b* of the bit 11 and the bit holder bore 12*a* is such that the shank does not slap or pound the sides of the bit holder bore 12*a* during use to wear the fit therebetween in a speedy manner.

Figure 5:
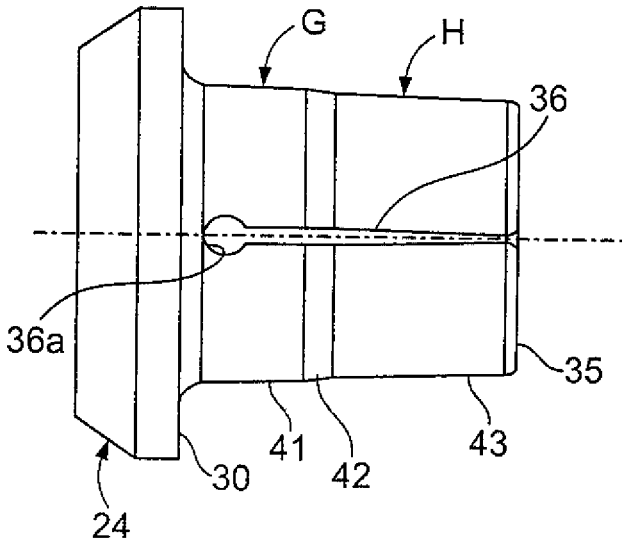
FIG. 5 is a top plan view of the bit holder shown in FIG. 3 as it appears when inserted in a bit block.

When the bit holder 12 is inserted in the bit block bore 16, as shown in FIG. 1, the outside of the shank 25 of the bit holder takes on the dimensions shown in FIG. 5. The diameter of the upper shank cylindrical portion 41 is 1.870 inches and the diameter of the lower shank cylindrical portion 43 is 1.830 inches. Referring to FIG. 6, as indicated above, with the upper and lower cylindrical shank portions of the prior art being circumferentially solid, i.e., without a slot, the tolerances necessary to provide cylindrical surface contact both at the upper shank cylindrical portion 41 and the lower shank cylindrical portion 43 are too exacting for complete or proper fit under normal mass commercial manufacturing techniques. Therefore, it was more likely in the prior art that possibly only one of the upper or lower shank cylindrical portions would be snugly fit in the bit block bore, if either. The resulting loose fit of the other of the upper or lower cylindrical shank portions would allow excessive movement to occur between the bit block bore and the bit holder shank. This movement during use would shorten the life of the bit holder-bit block assembly and, has resulted in bit holders popping out of the bit blocks during use. The ability of the slotted shank as shown in FIG. 5 to change its shape provides for a more complete surface fit or contact between the upper shank cylindrical portion of the bit holder shank and the upper cylindrical portion of the bit block bore together with the lower portion of the bit holder shank cylindrical portion and the lower portion of the bit block bore. As a result, the bit holder of the current invention stays snugly mounted in the bit block bore and prolongs the useful life of the bit holder and bit holder block assembly over that of the prior art.

Referring to FIG. 6, after the bit holder of the present invention is inserted into its bit block, the measured dimensions of the bit holder bore at J are 1.195±0.005 inches, at K is 1.195±0.005 inches, and at L is 1.195±0.005 inches. The axial distance between the back side 30 of the body flange 30 and each of the dimensions J, K and L given is ½ inch. The diameter of the bit holder bore at the distal end M of the shank is 1.195±0.005 inches. Since the diameter of the bit shank approximates 1.170 inches, in ordinary usage, the bit shank is able to rotate in the bit holder bore and yet be sufficiently closely fitted thereto to avoid shank slap or hammering that would tend to prematurely allow the bit assembly to fail in use. These dimensions and tolerances may vary depending on the manufacturer of the bit as well as the tolerances used for each part used in this assembly.

Figure 7:
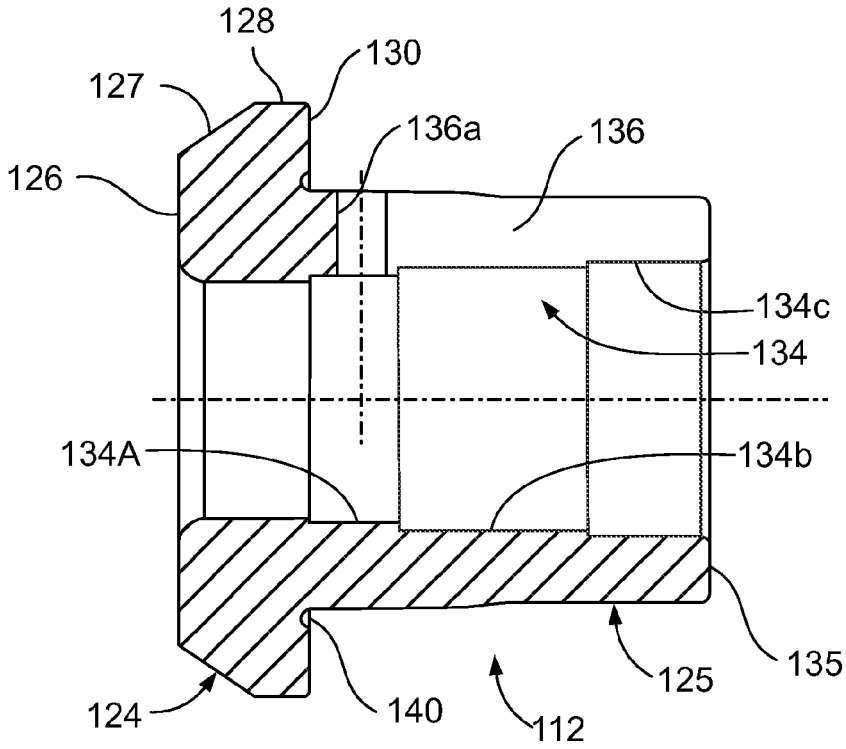
FIG. 7 is a cross section view of a modification of the bit holder of the present invention including a stepped, discontinuous central bore.

Referring to FIG. 7, a modification of the present invention generally at 112, includes features identical to the first embodiment, with such features numbered the same as in the first embodiment with the addition of a 1 in front thereof. The only exception being the stepped, discontinuous flanged bore, generally indicated at 134, with increasingly stepped portions 134*a*, 134*b*, and 134*c* from the top 136*a* of slot 136 to the distal end 135 of the shank 112. The modification 112 includes a front body portion 124 having an annular top surface 126, a bevel portion 127, a cylindrical tire portion 128, and an annular back face 130, all identical to the first embodiment 12.

Thus, an improved bit holder has been shown and described which is suitable for use in applications wherein the shank of a bit is sufficiently long to extend substantially through the length of the bit holder bore, which may extend beyond the distal end of the bit holder bore to allow a C clip or other fastener to secure the bit in the bit assembly. Such bits are presently used in trenching operations and coal mining operations that provide for bit assemblies of differing sizes having bits with differing shank diameters. Therefore, the aim in the appended claims is to cover all such bit assemblies that come within the true spirit and scope of the present invention.

What is claimed:

1. A bit holder for use in road milling, trenching and mining equipment as part of an assembly including a bit, said bit holder and a bit block, said bit being mountable in a first bore through said bit holder and extending completely therethrough and said bit holder being mountable in a second bore through said bit block, said bit holder comprising:

a front portion and at least one generally cylindrical shank portion extending axially rearwardly from said front portion defining an annular side wall, an elongate slot radially through said side wall extending axially from a distal end of said shank and terminating between said distal end and said front portion defining at least one angular segment of said shank being less than 360 degrees in circumferential length, an outer surface of said angular segment providing interference with said second bore on said bit block sufficient to maintain said bit holder in said bit block during use, and said bit holder bore including an outwardly radially extending taper substantially the length of said elongate slot and positioned adjacent thereto, said taper providing a space between said bit shank and said bit holder bore for said bit holder shank to collapse into when said holder is inserted into said bit block, while allowing said bit shank to maintain a rotatable mounting thereon.

2. A bit holder comprising:

a front body portion, a rear shank portion extending axially from said front body portion, a central bore extending axially through said rear shank portion, an axially oriented slot extending along at least a portion of said shank for providing an open area into which portions of said shank may extend as said shank is pressed onto a bit block bore, and a stepped bore on said bit holder bore internally adjacent said slot providing a substantially cylindrical bit holder bore when said shank is pressed onto said bit block bore.

3. A bit holder comprising:

a front body portion, a rear shank portion extending axially from said front body portion, a central bore extending axially through said rear shank portion, an axially oriented slot extending along at least a portion of said shank for providing an o en area into which s portions of said shank ma extend as said shank is pressed onto a bit block bore, and a discontinuous taper on said bit holder bore internally adjacent said slot providing a substantially cylindrical bit holder bore when said shank is pressed onto said bit block bore.

4. A bit holder and bit block, in combination, comprising:

a bit holder front portion and a generally cylindrical bit holder shank portion extending axially rearwardly from said front portion defining an annular side wall, an elongate slot radially through said side wall extending axially from a distal end of said shank and terminating between said distal end and said front portion defining a C-shape portion of said shank, an outer surface of said C-shape portion providing an interference with said second bore on said bit block sufficient to maintain said bit holder on said bit block during use, and said first bore through said shank of said bit holder including at least a portion adjacent said distal end thereof having a radially extending taper, an outer end of which is sized to substantially equal the amount of said interference between said bit holder shank and said second bore through said bit block.

* * * * *

UNITED STATES PATENT AND TRADEMARK OFFICE

CERTIFICATE OF CORRECTION

PATENT NO. : 8,540,320 B2
APPLICATION NO. : 12/417457
DATED : September 24, 2013
INVENTOR(S) : Phillip Sollami It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 285 days.

In the Claims

In claim 3 at line 8, “o en” should be --open--.

In claim 3 at line 8, after “which”, “s” should be eliminated.

In claim 3 at line 9, “ma” should be --may--.

Signed and Sealed this
Third Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,540,320 B2
APPLICATION NO. : 12/417457
DATED : September 24, 2013
INVENTOR(S) : Phillip Sollami It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 285 days.

In the Claims

Column 7

In claim 3 at line 19, “o en” should be --open--.

In claim 3 at line 19, after “which”, “s” should be eliminated.

In claim 3 at line 20, “ma” should be --may--.

This certificate supersedes the Certificate of Correction issued December 3, 2013.

Signed and Sealed this
Fourth Day of February, 2014

Michelle K. Lee

Michelle K. Lee
*Deputy Director of the United States Patent and Trademark Office*